US009072339B2

(12) United States Patent
Manolian et al.

(10) Patent No.: US 9,072,339 B2
(45) Date of Patent: Jul. 7, 2015

(54) CHILDREN'S PROGRESSIVE DEVELOPMENT ORTHOTIC SYSTEM

(75) Inventors: Richard James Manolian, Boxford, MA (US); Anthony John Howlett, San Bruno, CA (US); Heather Ashton Manolian, Boxford, MA (US)

(73) Assignee: Ashton Industries, Inc., Boxford, MA (US)

( * ) Notice: Subject to any disclaimer, the term of this patent is extended or adjusted under 35 U.S.C. 154(b) by 410 days.

(21) Appl. No.: 12/465,485

(22) Filed: May 13, 2009

(65) Prior Publication Data

US 2009/0307927 A1 Dec. 17, 2009

Related U.S. Application Data

(60) Provisional application No. 61/053,363, filed on May 15, 2008.

(51) Int. Cl.

| | |
|---|---|
| ***A43B 13/10*** | (2006.01) |
| ***A43B 13/38*** | (2006.01) |
| ***A43B 7/14*** | (2006.01) |
| ***A43B 17/14*** | (2006.01) |
| ***A43B 17/00*** | (2006.01) |
| ***A43B 3/30*** | (2006.01) |
| ***A43B 7/22*** | (2006.01) |
| ***A43B 7/28*** | (2006.01) |
| ***A43D 999/00*** | (2006.01) |

(52) U.S. Cl.

CPC . *A43B 17/14* (2013.01); *A43B 7/14* (2013.01); *A43B 17/003* (2013.01); *A43B 3/30* (2013.01); *A43B 7/22* (2013.01); *A43B 7/28* (2013.01); *A43D 999/00* (2013.01)

(58) Field of Classification Search

CPC ..... A43B 7/14–7/145; A43B 7/00; A43B 13/00–13/023; A43B 13/14–13/148; A43B 17/003; A43B 17/04

USPC ..... 36/43, 44, 88, 93, 112, 71

See application file for complete search history.

(56) References Cited

U.S. PATENT DOCUMENTS

| | | | | |
|---|---|---|---|---|
| 2,917,847 | A * | 12/1959 | Scholl | 36/181 |
| 4,791,736 | A * | 12/1988 | Phillips | 36/117.5 |
| 4,931,773 | A * | 6/1990 | Rosen | 340/573.1 |
| 5,014,041 | A * | 5/1991 | Rosen | 340/573.1 |
| 5,687,441 | A * | 11/1997 | Rachman et al. | 12/142 R |
| 6,854,199 | B2 * | 2/2005 | Polifroni | 36/44 |
| 6,966,131 | B2 * | 11/2005 | McCracken et al. | 36/155 |
| 7,008,386 | B2 | 3/2006 | Alaimo et al. | |
| 7,120,958 | B2 | 10/2006 | Copeskey et al. | |
| 7,210,250 | B2 * | 5/2007 | Gallegos | 36/44 |
| 7,266,913 | B2 * | 9/2007 | Axt et al. | 36/174 |
| 7,293,370 | B2 * | 11/2007 | Kaplan et al. | 36/8.4 |
| 7,426,794 | B2 * | 9/2008 | Swensen | 36/43 |
| 7,487,604 | B2 | 2/2009 | Perron, Jr. | |
| 7,690,133 | B2 * | 4/2010 | Olivieri | 36/97 |

(Continued)

*Primary Examiner* — Jila M Mohandesi

(74) *Attorney, Agent, or Firm* — Daniel N. Smith

(57) ABSTRACT

A system of progressively-sized orthotic inserts is provided to allow increasing measured support that corresponds with the changes that occur in a child's arch as the foot develops. The orthotic insert system is designed to address the specific needs found in the foot for children of ages of about 2-8 years. Each of the plurality of inserts is designed to encompass two shoe sizes and vary in arch height relative to the insert length so that motion control and stabilization for the child's foot is provided. In addition, a contoured heel cup and rear foot post is provided to position the foot in a neutral position.

9 Claims, 4 Drawing Sheets

(56) References Cited

U.S. PATENT DOCUMENTS

2004/0181976 A1* 9/2004 Copeskey et al. ..... 36/145
2005/0005476 A1* 1/2005 Kassai et al. ..... 36/44
2005/0257401 A1* 11/2005 Axt et al. ..... 36/43
2006/0080869 A1 4/2006 Johnson
2006/0096129 A1* 5/2006 Kaplan et al. ..... 36/112
2007/0011916 A1* 1/2007 Olivieri ..... 36/97
2008/0229612 A1* 9/2008 Sommer et al. ..... 36/44

* cited by examiner

CHILDREN'S PROGRESSIVE DEVELOPMENT ORTHOTIC SYSTEM

CROSS REFERENCE TO RELATED APPLICATIONS

This application claims the benefit of U.S. Provisional Application No. 61/053,363, filed May 15, 2008, the teachings of which are incorporated by reference.

FIELD

The present disclosure relates generally to footwear orthotics, and more particularly to a system of progressively sized orthotic inserts for children's shoes.

BACKGROUND

Orthotics is a portion of the health care medical profession involved with the design, development, fitting and manufacturing of custom inserts which are directed at bracing and/or straightening weak or ineffective joints or muscles, and which may be worn inside a patient's shoes to improve the efficiency and reduce the stresses of walking.

The foot is one of the most complex features of the human anatomy. It consists of twenty-six bones, thirty-three joints, one hundred and twelve ligaments, three arches, four layers of tissue on the sole of the foot, and twenty intrinsic muscles. In order to effectively eliminate foot and leg ailments, solid support and, in some cases, corrective positioning of the foot may be required.

Generally, due to the wide range of sizes of feet, orthotic inserts may be custom-made using a cast taken of a foot using plaster. Next, custom-made orthotics or insoles may be made from a mold, which is a replicate of the plaster cast, using synthetic resins or other materials. Custom orthotics for feet typically contain a relatively rigid, resilient base comprising a heel portion and an arch portion, contoured to fit the bottom surface of the foot. Orthotic inserts may be inserted into footwear to reduce pronation of feet and to provide a therapeutic and corrective effect for foot ailments.

Studies have shown that inadequate foot support in the formative years of children can cause long-term health issues with major joints. Although highly beneficial in correcting early onset of podiatric conditions, custom orthotics for a child may be considered cost prohibitive, with frequent size alternations needed due to the rapid growth of the feet and the changing body physiology of the child.

Children's foot development occurs from birth through about age 17, when all bones and growth plates have reached their final position. The most critical period of this development is through the age of 7, when a child's arch is forming. By age three, more than 50% of the normal pediatric population lacks a defined arch, and this number declines to 24% at age six. The vast majority of shoes that children between the ages of 2-7 wear lack any support in the medial arch area, and the results are increased muscle strain and general fatigue of the foot. As research has shown, children with a flat foot or lower than normal arch can benefit greatly from the use of an arch support, or an orthotic insert. In addition, active children with normally developing feet may benefit from better support inside their shoes to encourage proper foot development.

What is needed is a system of orthotic inserts which are mass producible in sizes to address the progressive development of children's feet and anatomical features that may be found in children's feet that may not be found in the adult foot and which provide the relative arch height to neutralize the foot while supporting the arch.

SUMMARY

In a first aspect, the present disclosure relates to an orthotic system for children, comprising a plurality of progressively-sized inserts for insertion into children's shoes, the inserts having an arch height and a length and configured to contact the plantar portion of a child's foot from the metatarsal heads, including the plantar arch, the inserts extending to include a contoured heel cup and a rear foot post. The height (H) of the arch is proportional to the length (L) of the insert, and the plurality of inserts are configured to be individually supplied and provided for children's footwear over the range of shoe sizes 7 to 13.

In another aspect the present disclosure relates to an orthotic system for children, comprising providing at least four progressively-sized inserts for insertion into children's shoes, the inserts having an arch height and a length, the inserts configured to contact the plantar portion of a child's foot from the metatarsal heads, including the plantar arch, and extending to include a contoured heel cup and further including a rear foot post. The height (H) of the arch is proportional to the length (L) of the insert, and the plurality of inserts are configured to be individually supplied and provided for children's footwear over the range of shoe sizes 7 to 13. The proportionality of the arch height (H) to the insert length (L) is described by the equation $H=0.425(+/-0.015)L-1.35(+/-0.05)$.

In still another aspect the present disclosure relates to a method of supplying a system of progressively sized orthotic inserts for children's shoes, where the inserts include a length and an arch height, comprising the steps of supplying at least a first pair of inserts whose length is related to a child's shoe size and supplying at least a second pair of inserts whose length is related to a child's larger shoe size, according to a predetermined sizing relationship, where the arch height (H) to the insert length (L) of the orthotic inserts may be described by the equation $H=0.425(+/-0.015)L-1.35(+/-0.05)$.

Still other objects and advantages of the present invention will become readily apparent to those skilled in the art from the following detailed description, wherein it is shown and described preferred embodiments of the invention. As will be realized the invention is capable of other and different embodiments, and its several details are capable of modification in various respects, without departing from the invention. Accordingly, the description is to be regarded as illustrative in nature and not as restrictive.

BRIEF DESCRIPTION OF THE DRAWINGS

The features, operation and advantages of the invention may be better understood from the following detailed description of the preferred embodiments taken in conjunction with the attached drawings, in which.

DETAILED DESCRIPTION

Figure 1:
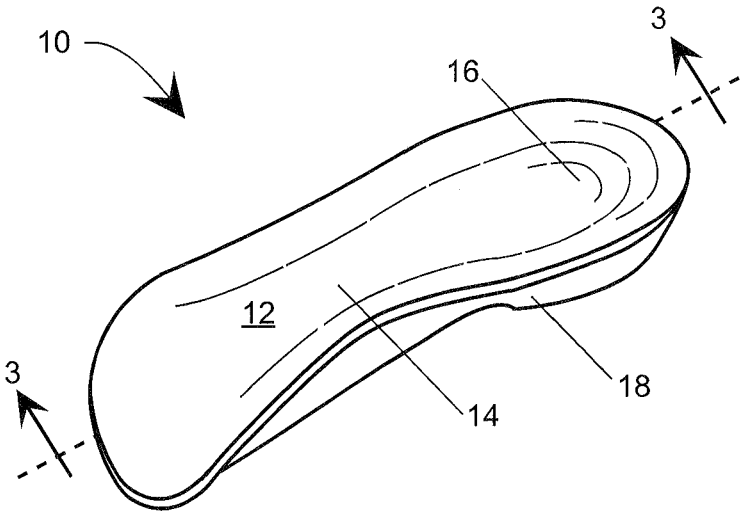
FIG. 1 is a prospective view of an orthotic insert (right foot) for a child's shoe which is part of a system of progressive sizing, according to the present disclosure.

For elements common to the various embodiments of the present disclosure, the numerical reference character between the embodiments is held constant, but distinguished by the alphanumeric character to the existing reference character. In other words, for example, an element referenced at 10 in the first embodiment is correspondingly referenced at 10A, 10B, and so forth in subsequent embodiments. Thus, where an embodiment uses a reference character to refer to an element, the reference character applies equally, as distinguished by alphanumeric character, to the other embodiments where the element is common.

The present disclosure relates to a molded orthotic footwear shoe insert system designed to address the developmental changes specific to a child's foot as may occur during childhood growth and foot maturity. The system comprises a construction method in conjunction with a design element that addresses the unique structure and development characteristics of a child. A child's foot at birth to ages 18 months to 2 years may best be described as fat, flat, and floppy. Typically children may start to walk around age 1, but do not have a normal gait cycle as found in adults. In the absence of pathology, around age 2, the foot, against gravity, weight bearing and forward momentum, may start to develop an arch. The arch may continue to increase in height until approximately age 8, when the foot more closely resembles an adult foot. These changes may occur because of overall growth of the foot in all three planes, in addition to osseous maturity of the bone structure, and atrophy of a prominent plantar fat pad found in most children. This may result in changes in the alignment of the joints that produce the heel strike, midstance, toe-off gait that is found in adults.

As the child's arch is forming, the foot is very mobile, biomechanically inefficient and unstable which can result in discomfort for the child, particularly during prolonged walking or during levels of sustained high activity. Typical children's shoe designs do not address these problems.

Inserts, such as orthotic inserts, may provide flexible support in the arch area, in addition to motion control and stabilization in the heel region of the foot. A system of graded sizes corresponding to anatomical arch development in children may be provided by a) increasing the vertical height the arch support area with each progressive insert size (length),
b) constructing the orthotic with a flexible thermomoldable material that has a thickness that may correspond to the weight and size of the child, and
c) constructing the orthotic incorporating a contoured heel cup with a rear foot post in the neutral position.

Accordingly, a system of four progressively-sized orthotic inserts may be provided to allow increasing measured support that corresponds with the changes that occur in a child's arch as the foot develops. The orthotic insert system is designed to address the specific needs found in the foot for children ages 2-8 years.

The inserts are manufactured from exhaustive molds and modifications from and for standard sizes for the listed size distribution. This may allow the insert to be formed as custom-molded insole with all of the characteristics of a prescription device, including a rear-foot post and a Progressive Arch Design, for mass production, with an enlarging arch curvature for each successive insole size (length).

The system of orthotics herein that provide progressive changes in the arch height relative to the length of the insert is understood to mean an application outside of prescription insole usage, in the mass-produced manufacturing entities, wherein all devices/inserts involve either a flat arch design or a limited arch design with correlation to standard podiatric model sizes.

Rear-foot post inclusion is disclosed herein for an application outside of prescription insole usage, in the mass-produced manufacturing entities, wherein all devices previous did not include or emphasize such a design characteristic. This involves incorporating a neutral rear foot post onto an orthotic that is specifically intended for the pediatric population. One purpose of the rear foot post may be to add a degree of additional control for hyper-mobile and pediatric flatfoot types by controlling excessive pronation. Foot types with excessive pronation respond relatively poorly when treated only with shoe gear or arch supports that lack this component.

Thus, an orthotic insert/device may be provided that contacts the plantar portion of the foot from the metatarsal heads, includes the plantar arch, and extends to include a contoured heel cup. The principles embodied in this pediatric orthotic disclosure may provide maximal benefit as the insert is in direct contact with the foot.

Consistent with all of the above, FIG. 1 is a prospective view of an exemplary orthotic insert (right foot) for a children's shoe which is part of a system of progressive sizing, according to the present disclosure. The insert 10 includes a top surface 12 including an arch support area 14 having regions of both convex and concave shape to accommodate the form of a given arch. In addition, the top surface 12 includes a contoured heel cup 16 for stabilizing the heel and may be textured to resist slipping. Further, the insert 10 includes a rear foot heel post 18 to place the foot in a neutral position. The orthotic insert may provide coverage of the plantar foot proximal to the metatarsal heads, the arch of the midfoot, and extend to the heel, as shown.

Figure 2:
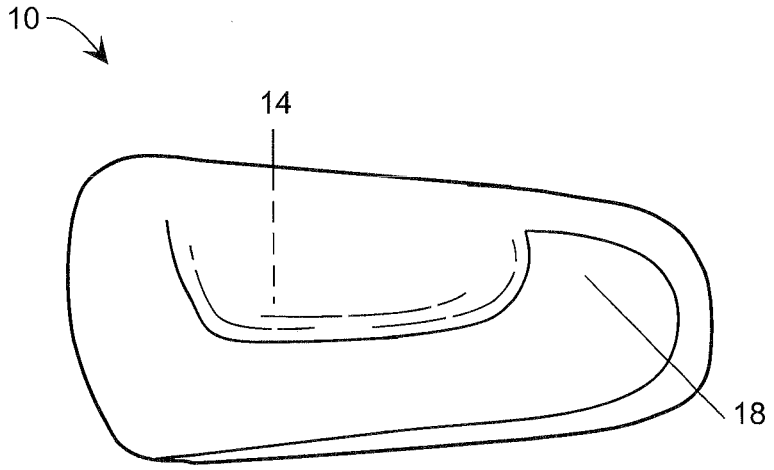
FIG. 2 is a bottom view of the insert of FIG. 1.

FIG. 2 is a bottom view of the insert of FIG. 1 illustrating the positioning of the heel post 18 and the overall general shape of the insert 10.

Figure 3:
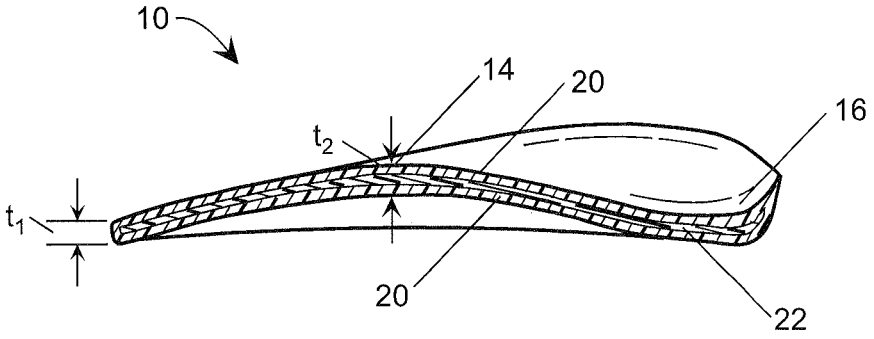
FIG. 3 is a cross-section view along lines 3-3 of FIG. 1.

FIG. 3 is a cross-section view along lines 3-3 of FIG. 1 illustrating the thickness profile. The insert may be constructed of a semi-flexible thermomoldable material 20 with a stiffening layer 22, whereby the thickness (t) may be varied based on the child's size and weight. For instance, the thickness $t_2$ at the arch may be thicker than the thickness at portions $t_1$ of the insert surrounding the arch. A thermomoldable material 20 may include foam material, such as a polyolefin foam, which may therefore include polyethylene or polypropylene foam. The thermomoldable material may also include elastomeric material, such as synthetic rubber or natural rubber, thermoplastic polyurethane elastomers, thermoplastic polyester elastomers, etc. The stiffening layer may include high-density polyethylene ($D \geq 0.935$ g/cc), as well as isotactic polypropylene. Such insert may have a flex modulus of greater than or equal to about 150,000 psi, such as in the range of 150,000 psi to 400,000 psi.

Figure 4A:
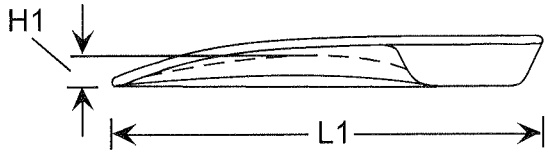
FIGS. 4A-4D are cross-sectional views of exemplary inserts which make up the progressive development orthotic system, according to the present disclosure, illustrating the arch height to length relationship for the system of a plurality of progressive sizes of inserts.
Figure 4B:
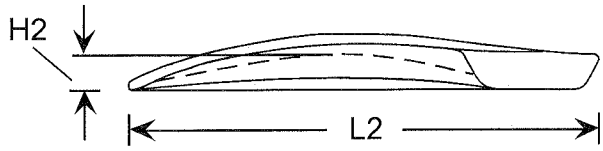
Figure 4C:
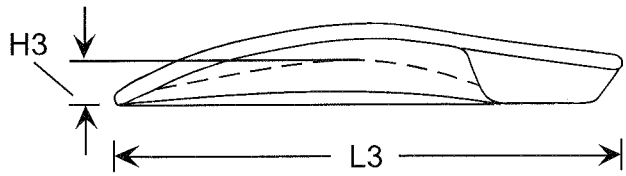
Figure 4D:
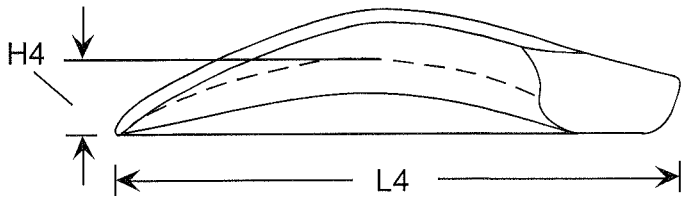

FIGS. 4A-4D are side views of the insert of FIG. 1 illustrating the arch height to length relationship for a system of four progressive sizes of inserts, according to the present disclosure. FIG. 4A is a cross-sectional view of an exemplary insert 10A for a child's extra small shoe size. The arch height is designated as H1 and the length L1. FIG. 4B is a cross-sectional view of an exemplary insert 10B for a child's small shoe size. The arch height is designated as H2 and the length L2. FIG. 4C is a cross-sectional view of an exemplary insert 10C for a child's medium shoe size. The arch height is designated as H3 and the length L3. FIG. 4D is a cross-sectional view of an exemplary insert 10D for a child's large shoe size. The arch height is designated as H4 and the length L4.

As one may note, the arch height (H1→H4) increases with the increase in the length (L1→L4) of the insert, so that as the foot grows, a progressively sized orthotic system for children's feet may be provided.

The orthotic insert system, according to the present disclosure, is designed to address the specific needs found in the foot for children with ages of about 2-8 years. Orthotic size selection is determined by standard children's shoe sizes, as shown below:

| | | Orthotic Insert Size | |
|---|---|---|---|
| | | Length | Height |
| X-Small: | Childs shoe size 7-8 | L1 (about 4¼") | H1 (about ½") |
| Small: | Childs shoe size 9-10 | L2 (about 4⅝") | H2 (about ⅝") |
| Medium: | Childs shoe size 11-12 | L3 (about 5") | H3 (about ¾") |
| Large | Child shoe size 13-1 | L4 (about 5½") | H4 (about 1") |

As noted above, each size of orthotic insert is intended to last through two shoe sizes.

Figure 5:
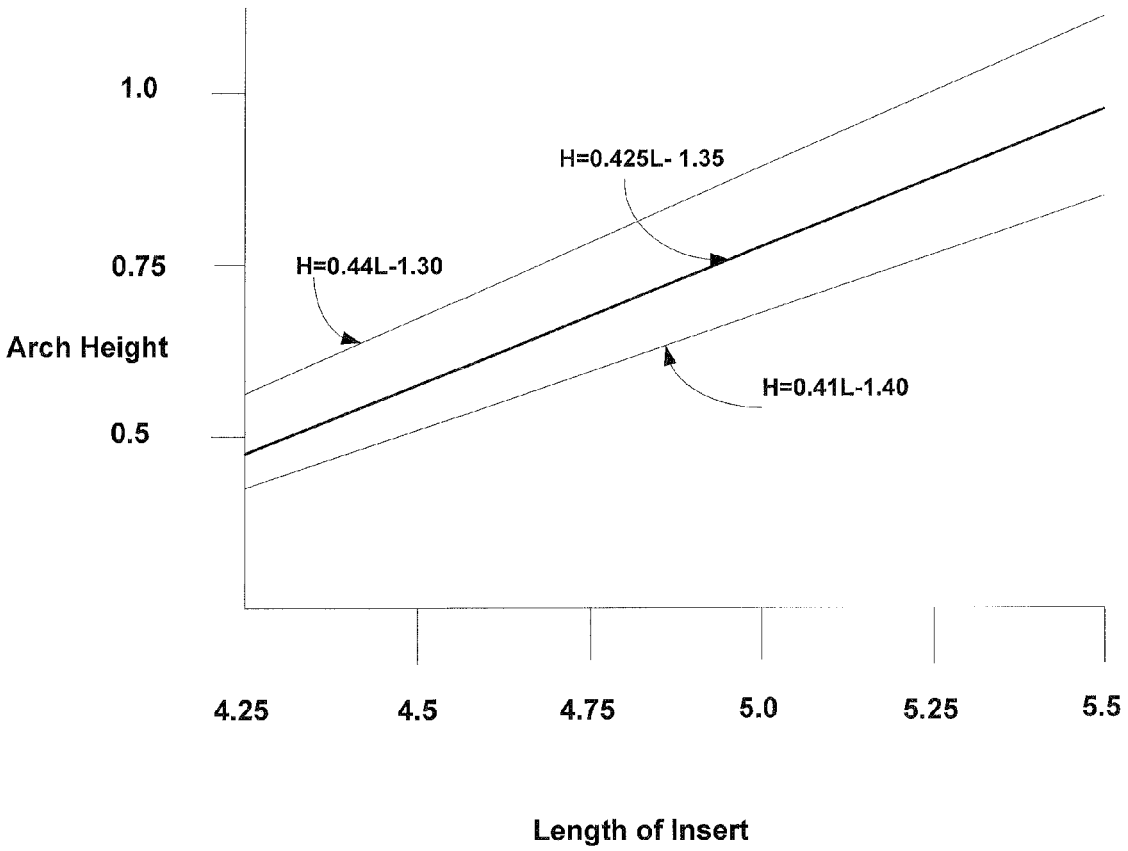
FIG. 5 is a graph of arch height to insert length for the plurality of inserts, according to the present disclosure.

The relationship between insert length (L) and arch height (H) may generally be described by the relationship H=0.425(+/−0.015)L−1.35(+/−0.05). See FIG. 5. In other words, the arch height may be anywhere from 0.410(L) to 0.440(L), minus the value of 1.35, plus or minus 0.05. Stated yet another way, the arch height and insert length may be any value that falls on or within the envelope of values illustrated in FIG. 5, by the line identified as H=0.41L−1.40 and the line identified as H=0.44L−1.3, over an insert length of 4.25 to 5.5 inches.

This disclosure provides a system comprising a plurality of orthotic inserts having features based on anatomical considerations found in the developing human foot commonly found in children ages 2-8 years. By taking anatomy into consideration, the system may provide a more comfortable and natural progression of orthotic insert sizes for children that need additional support for hyper-mobile, pediatric flat foot, or excessive pronation foot types. The system may support natural arch development to prevent foot problems later in life. The result of using such a system may be a reduction in muscle fatigue, strain, and an increase in biomechanical efficiency for developing feet.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of supplying an orthotic system for children aged 3 to 9 years old, comprising the steps of: forming a plurality of progressively-sized individually molded inserts, the inserts having an arch height, a length and a thickness, the inserts configured to contact the plantar portion of a child's foot from the metatarsal heads, including supporting the plantar arch, and extending to include a contoured heel cup, the inserts further including a rear foot post, wherein the inserts are adapted to provide coverage of the plantar foot proximal to the metatarsal heads, the arch of the midfoot, and extend to the heel;

wherein the height (H) of the arch is proportional to the length (L) of each insert, wherein the proportionality of the arch height (H) to the insert length (L) of each insert is described by the equation H=0.425(+/−0.015)L−1.35(+/−0.05); and wherein each progressively-sized insert is configured for insertion into one of a plurality of progressively-sized child shoes, wherein the plurality of progressively-sized child shoes ranges in shoe sizes 7 to 13, and further wherein each progressively-sized child shoe is adapted to fit a child's foot as the child's foot progressively grows.

2. The method of claim 1, wherein at least four progressively-sized inserts are formed that are configured for insertion into at least four progressively-sized child shoes.

3. The method of claim 1, wherein each insert comprises multiple layers of a thermomoldable material.

4. The method of claim 1, further comprising the step of adjusting the thickness of the insert, wherein the thickness of the insert varies directly with the age and weight of the child.

5. A method of supplying a system of progressively sized individually molded orthotic inserts for shoes for children aged 3 to 9 years old, wherein the inserts include a length and an arch height, comprising the steps of:

supplying at least a first pair of inserts configured for insertion into a child's shoe size that fits the child's foot; and supplying at least a second pair of inserts configured for insertion into a child's larger shoe size that is adapted to fit the child's foot after progressive growth;

wherein the arch height (H) to the insert length (L) of said orthotic inserts are described by the equation H=0.425(+/−0.015)L−1.35(+/−0.05), wherein the inserts are configured to contact the plantar portion of a child's foot from the metatarsal heads, including supporting the plantar arch, and extending to include a contoured heel cup, wherein the inserts are adapted to provide coverage of the plantar foot proximal to the metatarsal heads, the arch of the midfoot, and extend to the heel.

6. The method of claim 5, wherein said child's shoe sizes range from 7 to 1.

7. The method of claim 5, further comprising the step of supplying at least a third pair of inserts configured for insertion into a child's still larger shoe size than said second pair of inserts that is adapted to fit the child's foot after progressive growth.

8. The method of claim 7, further comprising the step of supplying at least a fourth pair of inserts configured for insertion into a child's still larger shoe size than said third pair of inserts that is adapted to fit the child's foot after progressive growth.

9. The method of claim 5, wherein the inserts further include a rear foot post.

* * * * *